US010186387B1

(12) United States Patent
Abendschoen

(10) Patent No.: US 10,186,387 B1
(45) Date of Patent: Jan. 22, 2019

(54) ELECTRICAL CONTROL DEVICE

(71) Applicant: E.G.O. Elektro-Geraetebau GmbH, Oberderdingen (DE)

(72) Inventor: Robin Abendschoen, Eppingen-Muehlbach (DE)

(73) Assignee: E.G.O. Elektro-Geraetebau GmbH, Oberderdingen (DE)

( * ) Notice: Subject to any disclaimer, the term of this patent is extended or adjusted under 35 U.S.C. 154(b) by 0 days.

(21) Appl. No.: 15/711,599

(22) Filed: Sep. 21, 2017

(51) Int. Cl.
*H01H 3/20* (2006.01)
*H01H 3/08* (2006.01)

(52) U.S. Cl.
CPC ..... *H01H 3/20* (2013.01); *H01H 3/08* (2013.01)

(58) Field of Classification Search
CPC ..... H01H 3/20; H01H 3/08; H01H 19/36; H01H 19/11; H01H 19/56; H01H 19/63
USPC ..... 200/43.11
See application file for complete search history.

(56) References Cited

U.S. PATENT DOCUMENTS 6,211,582 B1 4/2001 Reimold et al.
7,629,549 B2 * 12/2009 Huang ..... H01H 19/63 200/11 R
8,076,603 B2 * 12/2011 Huang ..... H01H 3/20 200/336
2012/0298494 A1 * 11/2012 Mahida ..... G05G 5/06 200/336
2015/0303009 A1 * 10/2015 Seo ..... H01H 19/04 200/4
2016/0201774 A1 * 7/2016 Fukunaga ..... H01H 19/14 74/504

* cited by examiner

*Primary Examiner* — Edwin A. Leon
(74) *Attorney, Agent, or Firm* — Alston & Bird LLP

(57) ABSTRACT

An electrical control device has a control device casing, switching means being adapted for rotary operation in the control device casing, unlockable blocking means and a rotating shaft for rotary operation of the switching means, wherein the rotating shaft runs through an unlockable blocking means. The blocking means and the rotating shaft have two projections and two corresponding recesses. In a blocking position of the control device the projections are engaging into the recesses for blocking a rotation, and in a rotation position the projections are positioned or moved outside of the recesses for free rotation of the rotating shaft. For unlocking the blocking means or for a transition from the blocking position to the rotation position to take place an axial movement of the rotating shaft along its longitudinal axis is effected. In a simple way, the rotating shaft needs to be pressed into the control device for unlocking.

14 Claims, 3 Drawing Sheets

ELECTRICAL CONTROL DEVICE

TECHNOLOGICAL FIELD

The invention relates to an electrical control device for home appliances.

BACKGROUND

Such an electrical control device for home appliances is known from U.S. Pat. No. 6,211,582 for example. The electrical control device has a rotating shaft in a housing of the control device for rotary operation of rotary switches or switching means in general in the housing. For avoiding unauthorized operation by children, a blocking device is provided that is also necessary for safety reasons. Only after the rotating shaft has been pressed into the housing a rotation of the shaft and in consequence a rotary operation is possible. Such a blocking device needs to be able to withstand rather significant forces to really be a safety measure.

BRIEF SUMMARY

It is thus an object of the present invention to provide for an electrical control device that allows increased functionality compared with solutions known in the prior art. It is a further object of the present invention to provide for an electrical control device that has an increased safety against unwanted rotary operation of the control device.

This is solved by an electrical control device. Advantageous and preferred configurations of the invention are the subject of the further claims and are explained in more detail below. The wording of the claims is made the content of the description by means of express reference.

The invention relates to an electrical control device with a control device casing, switching means being adapted for rotary operation in the control device casing, a rotating shaft for rotary operation of the switching means, wherein the rotating shaft runs through an unlockable blocking means and blocking means. The blocking means and the rotating shaft have two projections and two corresponding recesses. In a blocking position of the control device the projections are engaging into the recesses for blocking a rotation, and in a rotation position the projections are positioned outside of the recesses for free rotation of the rotating shaft. For unlocking the blocking means or for a transition from the blocking position to the rotation position to take place an axial movement of the rotating shaft along its longitudinal axis is effected. In a simple way, the rotating shaft is pressed into the control device for unlocking. The provision of two projections and two recesses, that means a blocking of rotation at two points, is much more effective and can withstand larger forces or torques, respectively.

The rotary shaft may run through the switching means, which is a customary way. That is not mandatory, the switching means can be provided in any way to be activated by a rotating shaft.

The control device may have a rotating shaft being movable along its longitudinal axis against a general elastic force, in particular against a spring. The spring may be a metallic spring or made from synthetic material.

The rotating shaft is formed as to be pressed against a counter force of the spring for a transition from the blocking position to the rotation position. This avoids unintended unlocking of the blocking means. It is a customary safety measure against an operation by small children.

The spring is preferably provided in the control device casing. It could also be located outside, for example at a front face or a back face. Preferably the spring is at a free end of the rotating shaft in the control device casing.

In an embodiment, the rotating shaft has only projections or only recesses. This allows for easier manufacturing. Preferably, the rotating shaft has only recesses.

The rotating shaft is preferably provided with a blocking disc, wherein the blocking disc extends around the rotating shaft and wherein the projections or the recesses are provided on the blocking disc. Such a blocking disc is known in the art for easier provision of the projections or the recesses. It also allows for larger forces to be applied.

In an embodiment, the two recesses have different width and the two corresponding projections do also have different width. This allows for the option that a blocking position can only take place in one single position. At least the biggest projection can only engage with its corresponding biggest recess. Both or all pairs should have the same ration of width to each other corresponding to the width of the respective recess.

Preferably, the recesses or projections are provided on the rotating shaft in any position except axially opposite to each other. This allows for the provision of only one single blocking position even in the case of all the projections or all the recesses to have the same size or width, respectively.

It can be provided that the rotating shaft and the blocking disc are in one piece. They may preferably be produced in one step from the same material, which may be in a moulding step when being made from synthetic material or in a casting step when being made from metal.

The blocking means can be provided outside of the control device. This allows for a retroactive mounting of a blocking device on a control device that has not been provided for this and that does also not have much spare space inside or a part of the blocking device or the whole blocking device. In a preferred embodiment, the blocking means can be provided on the front side of the control device.

In an embodiment, the blocking means may comprise a plate from sheet material, wherein the projections or the recesses on the blocking means are provided on the plate. The plate may be made from sheet metal. Such a plate is strong enough and can also be easily worked as is needed. The plate may have two projections formed in it.

The projections may be formed as lugs being punched out and bent outwards in the same direction out of the sheet material. This is especially easy in the case of sheet metal.

The plate may have at least two threads for mounting screws for the control device to a cover or the like and a through hole for the rotating shaft. Preferably the threads are evenly distributed around the through hole.

In an alternative embodiment, the plate has a through hole, in particular a central through hole, for the rotating shaft in the plate. A thread is provided directly in the through hole or on a short protuberance around the through hole for mounting the control device to a cover or the like. The short protuberance with the thread may be stuck through an opening in the cover and be fixed with a nut from the front side. Then there is no need for additional threads in the plate.

The lugs can preferably be bent out of the plate at a bending line, wherein the two bending lines for the two bent out lugs are not parallel to each other and do also not point through the rotating shaft. Preferably, the two bending lines can be rotary reflected with an angle of rotation of 90°.

These and further features are evident not only from the claims but also from the description and the drawings, the individual features each being implemented by themselves or in multiples in the form of subcombinations for an embodiment of the invention and in different fields and being able to be advantageous and independent protectable embodiments for which protection is claimed here. The division of the application into individual sections and subheadings does not limit the general validity of the statements made thereunder.

BRIEF DESCRIPTION OF THE SEVERAL VIEWS OF THE DRAWINGS

Further details and advantages of the invention will become apparent from the following description of an exemplary embodiment of the invention that is shown in the figures in a rather schematic way, wherein the figures show.

DETAILED DESCRIPTION

Figure 1:
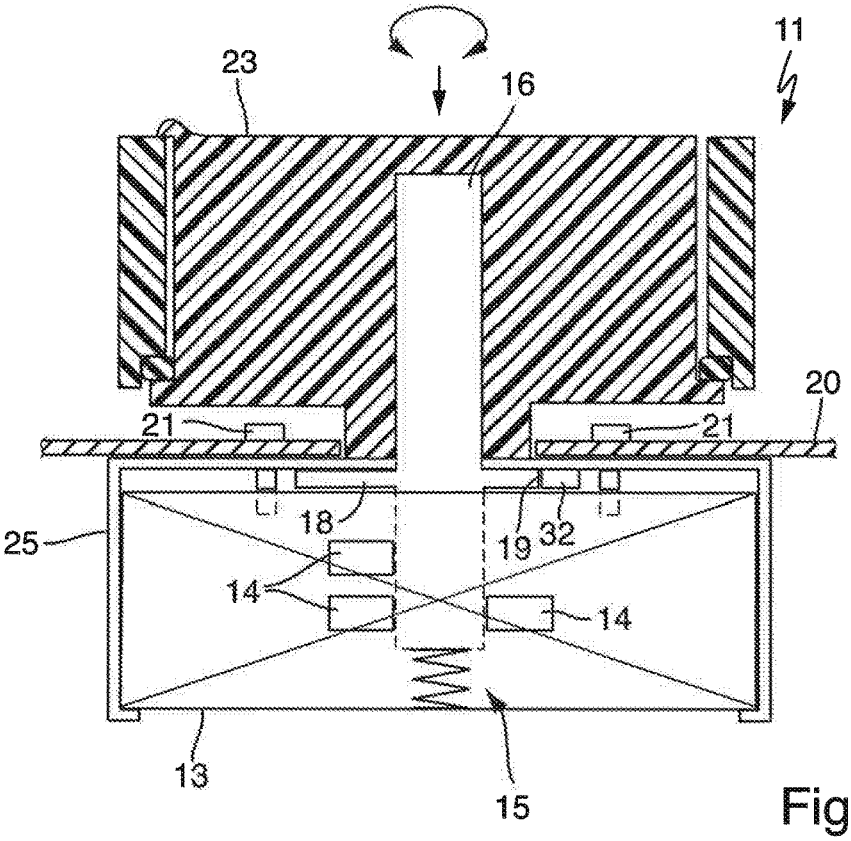
FIG. 1 is a side view of an electrical control device according to the invention mounted to a cover.

In FIG. 1, a side view of an electrical control device 11 according to the invention is shown. The electrical control device 11 has a casing 13 containing schematically shown switching means 14 inside. Electrical control device 11 has a rotating shaft 16 in the casing 13 and projecting from it, wherein the rotating shaft 16 runs through the switching means 14 or at least acts upon these switching means 14 for switching operation, preferably by rotation. This is not shown in detail but is known to a person skilled in the art.

On rotating shaft 16, a blocking disc 18 is provided, preferably in one piece, for example the whole shaft 16 is cast from metal.

Figure 2:
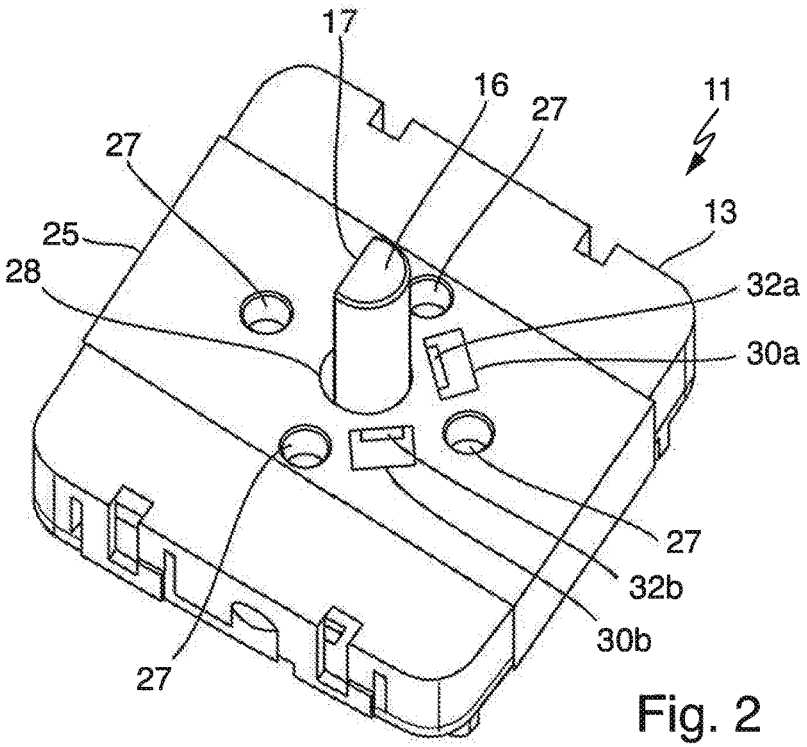
FIG. 2 is an oblique view of the electrical control device from above.

For mounting electrical control device 11 to a cover 20, screws 21 are shown which run through the cover 20 and are threaded into screw holes 27 of a mounting plate 25, which can be seen in detail in FIG. 2.

Rotating shaft 16 carries a knob 23 for rotary operation of the electrical control device 11. Knob 23 may be affixed to rotating shaft 16 in conventional manner, and rotating shaft 16 has a D form 17, which can be taken from FIG. 2, for blocking a twisting movement of the two relative to each other.

Rotating shaft 16 is mounted in electrical control device 11 or in its casing 13, respectively, in conventional manner, for example according to U.S. Pat. No. 6,211,582 mentioned above. A spring 15 is schematically depicted against which rotating shaft 16 may be pressed when pressing rotating shaft into the control device or into the casing 13, respectively, as indicated by the arrow above knob 23. This pressing is against the force of a spring 15 and displaces rotating shaft 16 and blocking disc 18 in axial direction into the casing 13. FIG. 1 shows a blocking position of electrical control device 11, which can be solved or unlocked by pressing knob 23 with rotating shaft 16 into a casing 13. After unlocking the blocking position, knob 23 may be rotated as indicated by the second arrow for acting on the switching means 14. The blocking means for allowing the blocking position as well as unlocking this blocking position are the core of this invention.

When looking at FIG. 2, it can be seen that mounting plate 25 is on top of casing 13 of electrical control device 11. It is provided with four screw holes 27 as threads for mounting to the cover 20 so that the control device 11 is also mounted to the cover 20. Rotating shaft 16 runs through a through hole 28 in mounting plate 25. In an alternative embodiment, a central thread could be provided around the through hole 28 as mentioned before.

A part of the blocking means on the side of the mounting plate 25 is provided by two projecting lugs 32*a* and 32*b* which have been stamped out of the mounting plate 25 leaving openings 30*a* and 30*b*. The projecting lugs 32*a* and 32*b* are bent at an angle of about 90° to the plane of mounting plate 25. Furthermore, they are spaced apart with an angle of about 90° around a rotation axis of rotating shaft 16, which can be taken from FIGS. 5 to 7. More important, projecting lug 32*a* is narrower or smaller than projecting lug 32*b*. This can also be taken from the following figures and is expressly shown in detail in FIG. 8.

Projecting lugs 32*a* and 32*b* are each bent out of mounting plate 25 along a respective bending line, and the two bending lines can be rotary reflected with an angle of rotation of 90°. This has been explained before and has the purpose of providing projecting lugs 32*a* and 32*b* with highest resistance against bending or breaking or shearing, respectively, with a force rotating around rotating shaft 16.

Figure 3:
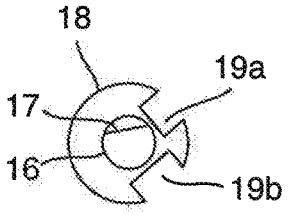
FIG. 3 is a view from above onto a rotating shaft of the electrical control device.
Figure 4:
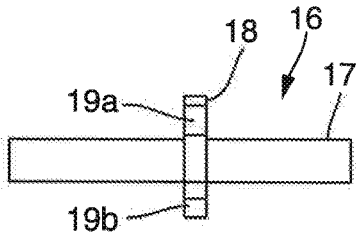
FIG. 4 is a side view of the rotating shaft of FIG. 3.

In FIGS. 3 and 4 the rotating shaft 16 is shown. Rotating shaft 16 has a well-known D form 17. Rotating shaft 16 is furthermore provided with a blocking disc 18, preferably fabricated in one piece for highest resistance. It can be made of metal. In blocking disc 18, two recesses 19 are provided which have a rather rectangular form. Recess 19*a* is narrower than recess 19*b*. This can also be taken from FIG. 8 with a direct comparison of recesses 19*a* and 19*b* to each other and projecting lugs 32*a* and 32*b* to each other.

Figure 5:
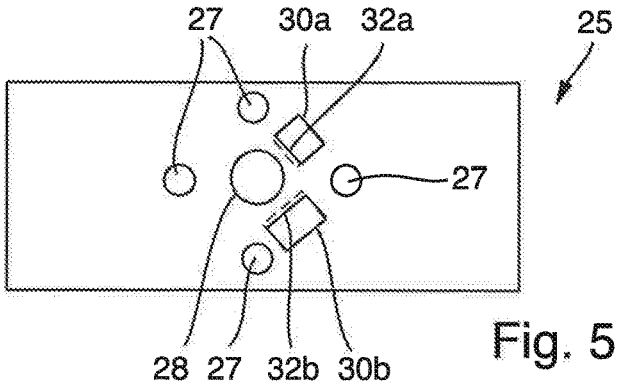
FIG. 5 is a view from above onto a mounting plate on the electrical control device of FIG. 2.
Figure 6:
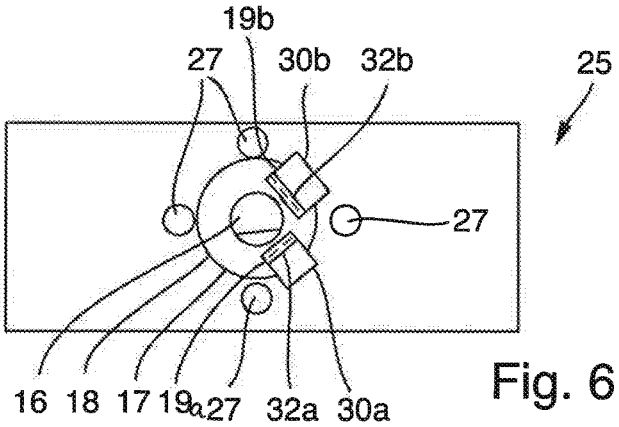
FIG. 6 is a view onto the underside onto the mounting plate of FIG. 5 with the rotating shaft inserted and being in the blocking position.

From the view onto mounting plate 25 of FIG. 5 it can be taken that openings 30*a* and 30*b* as well as projecting lugs 32*a* and 32*b* are disposed in rotation direction for about 90°. However, this is not mandatory. They should only be apart and have a certain distance between them for stability. Projecting lugs 32*a* and 32*b* are bent to the underside of mounting plate 25, as shown in FIG. 6. In FIG. 6 rotating shaft 16 is inserted from the underside of mounting plate 25. FIG. 6 shows the blocking position, wherein the narrower projecting lug 32*a* is in the narrower recess 19*a* of blocking disc 18. The bigger projecting lug 32*b* is in the bigger recess 19*b*. It can readily be understood that in this blocking position of FIG. 6, a rotation of rotating shaft 16 is blocked not by one projecting lug only, but by two projecting lugs. This can easily double the blocking stability for a safe and secure blocking of a rotation of rotating shaft 16.

For leaving blocking position to enable knob 23 to be rotated, rotating shaft 16 can be pushed into casing 13, whereby the blocking disc 18 is being pushed away from mounting plate 25 for a distance that is more than the height of projecting lugs 32*a* and 32*b* over mounting plate 25. Accordingly, the blocking function is no more present or unlocked, and rotating shaft 16 can be rotated freely. In FIG.

7 rotating shaft 16 has been rotated anti-clockwise for about 90°. This means that blocking disc 18 completely covers projecting lug 32*a*, so a blocking is not possible in this position. Projecting lug 32*b* is only partly covered, which can be seen from FIG. 7. However, already this partial covering would be sufficient for rotating shaft 16 together with blocking disc 18 remaining in the rotation position. In addition to recess 19*a* being too narrow for projecting lug 32*a* to move into, blocking disc 18 also is pressed against projecting lug 32*a* to avoid a blocking.

Figure 7:
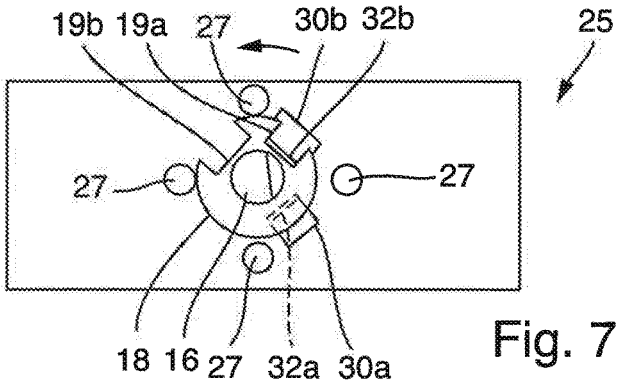
FIG. 7 is the arrangement of FIG. 6 with the rotating shaft being moved from the blocking position to the rotation position and being rotated for about 90°.
Figure 8:
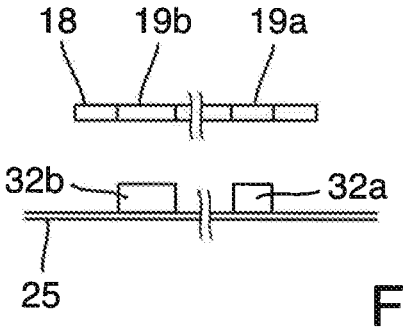
FIG. 8 is a schematic side view on recesses in a blocking disc of the rotating shaft in comparison to projecting lugs of the mounting plate.

It can easily be taken from a comparison of FIGS. 6 and 7 that there is only one blocking position for rotating shaft 16 relative to mounting plate 25 and projecting lugs 32*a* and 32*b*. By providing projecting lugs 32*a* and 32*b* with different size as well as recesses 19*a* and 19*b* with corresponding, different size, this rotating shaft 16 with blocking disc 18 could also be used with other blocking devices or mounting plates, respectively, having only one single projecting lug, if this single projecting lug would have a size corresponding to the bigger projecting lug 32*b*. It will then only fit into the bigger recess 19*b*. So there is also only one single blocking position although two recesses are provided in the blocking disc. This enables rotating shaft 16 to be used more universal.

That which is claimed:

1. An electrical control device comprising:

a control device casing;

a switching means being adapted for rotary operation in said control device casing;

an unlockable blocking means; and a rotating shaft for rotary operation of said switching means, wherein said rotating shaft runs through said unlockable blocking means, wherein:

said blocking means and said rotating shaft have two projections and two corresponding recesses;

in a blocking position of said control device said projections are engaging into said recesses for blocking a rotation;

in a rotation position said projections are positioned outside of said recesses for free rotation of said rotating shaft; and a transition from said blocking position to said rotation position takes place by an axial movement of said rotating shaft along its longitudinal axis, and wherein said rotating shaft is movable along said longitudinal axis against a spring.

2. The control device according to claim 1, wherein said rotating shaft has to be pressed against a compressive force of said spring for a transition from said blocking position to said rotation position.

3. The control device according to claim 1, wherein said spring is provided in said control device casing.

4. The control device according to claim 1, wherein said rotating shaft comprises only projections or only recesses.

5. The control device according to claim 1, wherein said rotating shaft is provided with a blocking disc, wherein said blocking disc extends around said rotating shaft and wherein said projections or said recesses are provided on said blocking disc.

6. The control device according to claim 1, wherein said at least two recesses have different width and wherein said two corresponding projections also have different width, both with the same ration of width to each other corresponding to a width of said respective recess.

7. The control device according to claim 1, wherein said recesses or said projections are provided on said rotating shaft in any position except axially opposite to each other.

8. The control device according to claim 1, wherein said rotating shaft and said blocking disc are in one piece.

9. An electrical control device comprising:

a control device casing;

a switching means being adapted for rotary operation in said control device casing;

an unlockable blocking means; and a rotating shaft for rotary operation of said switching means, wherein said rotating shaft runs through said unlockable blocking means, wherein:

said blocking means and said rotating shaft have two projections and two corresponding recesses;

in a blocking position of said control device said projections are engaging into said recesses for blocking a rotation;

in a rotation position said projections are positioned outside of said recesses for free rotation of said rotating shaft; and a transition from said blocking position to said rotation position takes place by an axial movement of said rotating shaft along its longitudinal axis, wherein said blocking means are provided on a front side of said control device, and wherein said blocking means comprises a plate from sheet material, wherein said projections or said recesses on said blocking means are provided on said plate.

10. The control device according to claim 9, wherein said plate is made from sheet metal and comprises two projections.

11. The control device according to claim 10, wherein said projections are lugs being punched out and bent outwards in said same direction out of said sheet material.

12. The control device according to claim 9, wherein said plate comprises at least two threads for mounting screws for said control device to a cover and a through hole for said rotating shaft.

13. The control device according to claim 9, wherein said plate comprises a through hole for said rotating shaft and comprises one thread in or around said through hole for mounting said control device to a cover.

14. The control device according to claim 9, wherein said lugs are bent out of said plate at a bending line, wherein said two bending lines for said two bent out lugs are not parallel to each other and do also not point through said rotating shaft.

* * * * *